US005570842A

United States Patent [19]

Kindley

[11] Patent Number: 5,570,842

[45] **Date of Patent: *Nov. 5, 1996**

[54] LOW MASS, THROUGH FLOW ARMATURE

[75] Inventor: David W. Kindley, Newport News, Va.

[73] Assignee: Siemens Automotive Corporation, Auburn Hills, Mich.

[ * ] Notice: The term of this patent shall not extend beyond the expiration date of Pat. No. 5,341,994.

[21] Appl. No.: 348,701

[22] Filed: Dec. 2, 1994

[51] Int. Cl.[6] ..... F02M 51/00

[52] U.S. Cl. ..... 239/585.1; 239/585.5; 251/129.15; 251/129.16

[58] Field of Search ..... 239/585.3, 585.5, 239/585.1; 251/129.15, 129.16

[56] References Cited

U.S. PATENT DOCUMENTS

| | | | |
|---|---|---|---|
| 5,114,077 | 5/1992 | Cerny | 239/585.3 |
| 5,192,048 | 3/1993 | Wakeman | 239/585.3 |
| 5,299,776 | 4/1994 | Brinn, Jr. et al. | 239/585.3 |
| 5,341,994 | 8/1994 | Wakeman | 239/585.3 |

*Primary Examiner*—Kevin P. Shaver
*Assistant Examiner*—Lisa Douglas
*Attorney, Agent, or Firm*—Russel C. Wells

[57] ABSTRACT

A typical solenoid-operated fuel injector comprises a housing forming an enclosure which contains a solenoid coil that is selectively energized by electric current to operate the fuel injector. An inlet connector tube extends into a stator to convey liquid fuel into the enclosure, to a valve via which fuel is ejected from the enclosure. A valve needle is disposed within the enclosure between the stator and the valve and is operated by the solenoid coil acting through a spring-biased armature to open and close a flow path through the enclosure between the inlet connector tube and the valve. The stator forms a portion of a magnetic circuit path that directs magnetic flux across a working gap that is disposed within the enclosure between an end of the stator and on one side of the armature wherein the one side of the armature causes impact forces to be exerted axially on the stator during the opening and closing of the flow path. In accordance with the present invention, impact-minimization passages are provided to minimize the effect of such impact forces, and the impact-minimization passages comprises on the armature multi-dimensional fluid passages through the armature that minimizes the effect of such impact forces in comparison to the effect of such impact forces in the absence of the multi-dimensional fluid passages.

6 Claims, 1 Drawing Sheet

LOW MASS, THROUGH FLOW ARMATURE

FIELD OF THE INVENTION

This invention relates generally to electrically operated valves, such as fuel injectors for injecting liquid fuel into an internal combustion engine, and particularly to a fluid flow path through an armature in such a valve.

BACKGROUND OF THE INVENTION

Typically, a solenoid valve comprises an armature movable between a first and second position. The extremes of these first and second positions are often defined by mechanical stops. Armatures can be moved in one direction by an electro-magnetic force generated by a solenoid and moved in the opposite direction by a return or bias spring. When the armature impacts a stop and because of its mass it tends to bounce. Therefore, to reduce bounce and its detrimental effects, many parameters may be changed, one being the mass of the armature. Each bounce of the armature causes the valve element to meter a small uncontrolled amount of fuel into the engine, to the detriment of emissions. As can be appreciated, the leakage of fuel into the engine will also result in very unfavorable fuel economy. Furthermore, the bounce of the armature affects the operation of a fuel injector by causing excessive wear in the valve seat area.

The armature is typically a solid structure with drilled passages or "fuel holes" that allow fluid to pass through the armature to the valve. For armatures where the flow rate is high, these drilled passages can become quite large and negatively impact magnetic performance due to insufficient magnetic path area. Unfortunately, increasing the magnetic path area to correct for the drilled holes increases the mass of the armature, which may negatively impact the dynamic characteristics of the armature.

It is seen then that it would be desirable to have a solution to the problems created by drilled passages in armature pieces.

SUMMARY OF THE INVENTION

This need is met by the present invention, wherein a solenoid valve armature meeting the needs for low mass requirements provides a fluid flow path through the armature, without causing loss of magnetic performance.

Briefly, the invention comprises the implementation of certain constructional features into the fuel injector in the armature element. Principles of the invention are of course potentially applicable to styles of fuel injectors other than the one specifically herein illustrated and described.

In accordance with one embodiment of the present invention, the armature is modified by incorporating multi-dimensional fluid passages through the armature that reduces the mass of the armature to minimize the effect of impact forces on the armature in comparison to the effect of such impact forces in the absence of the multi-dimensional fluid passages. Ribs are added on the valve needle side of the armature to maintain the needed or desired magnetic circuit path.

For a full understanding of the nature and objects of the present invention, reference may be had to the following detailed description taken in conjunction with the accompanying drawings and the appended claims.

DESCRIPTION OF THE PREFERRED EMBODIMENT

Figure 1:
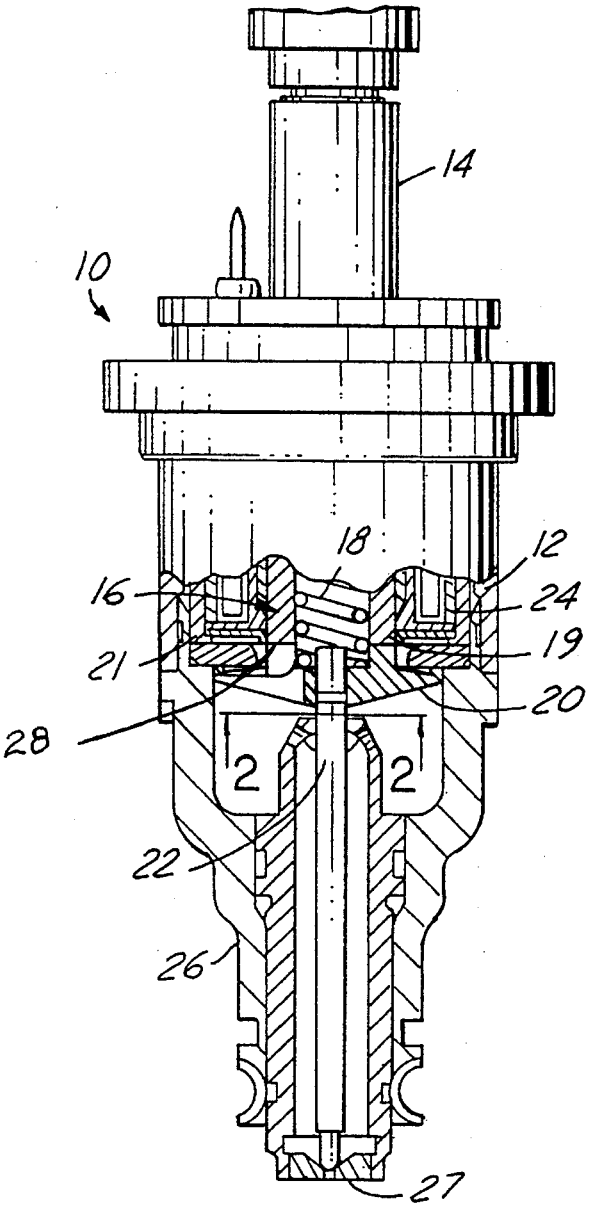
FIG. 1 is an elevation view, partly in cross section, through a fuel injector embodying the present invention.
Figure 3:
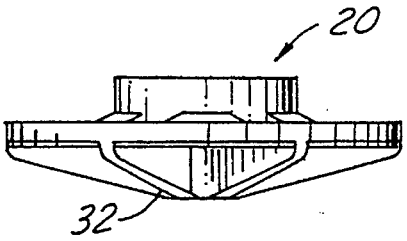
FIG. 3 is an elevation view of the armature of FIG. 2.

Referring to FIG. 1 there is illustrated partly in cross section, a typical fuel injector 10 designed to inject fuel into an internal combustion engine. The injector 10 includes a non-magnetic housing 12; an inlet connector 14 in the form of a tube; a stator 16; a helical coil spring 18; a spring pocket 17: an armature 20; a valve needle 22; a solenoid coil assembly 24, including electrical terminals extending therefrom via which the fuel injector is connected with an electrical operating circuit for selectively energizing the solenoid coil; and a valve body assembly 26 including a valve 27. The stator 16 is an integral frame, having an inner tubular member forming an inner pole 19 and outer tubular member forming an outer pole 21. The inner and outer tubular members are joined together at one end forming a closed end. U.S. Pat. No. 5,341,994, is an example of the injector 10 of this application, but such patent does not show or disclose the invention herein.

The injector is of the type which is commonly referred to as a top-feed type, wherein fuel is introduced through inlet connector 14 and emitted as an ejection from the axially opposite valve or tip end 27.

The differences essentially relate to the inventive features of the present disclosure. The invention is used in a solenoid operated valve as the armature element of the magnetic circuit of the solenoid. In the specific case illustrated, the armature is a protruding inner pole design where fluid flow must pass through the armature.

In FIG. 1, the inlet connector tube 14 is disposed within the housing where it conveys pressurized liquid fuel into the stator 16. The lower end of the stator 16 and the upper end or protruding inner pole of the armature 20 cooperatively define a working gap 28. Because the axial dimension of the working gap is small, it appears in FIG. 1 simply as a line thickness. The valve needle 22 extends through a central aperture of the armature and is integral with the armature 20 and functions to open and close the valve 27.

Figure 2:
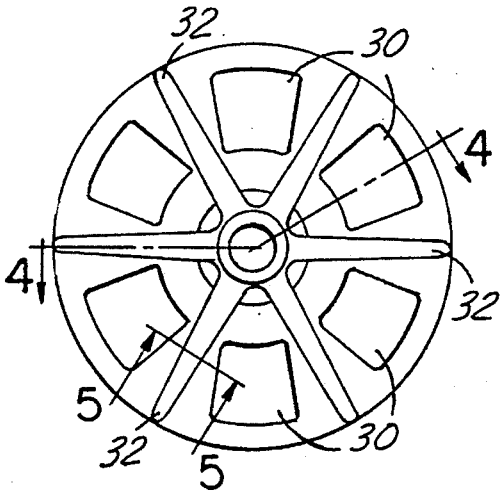
FIG. 2 is a plan view of the armature of the fuel injector of FIG. 1 taken along line 2—2 of FIG. 1.
Figure 4:
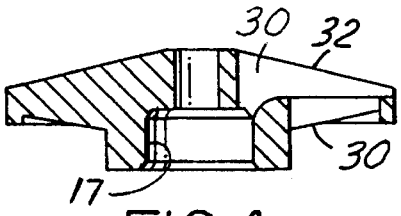
FIG. 4 is a sectional view taken along line 4—4 of FIG. 2.
Figure 5:
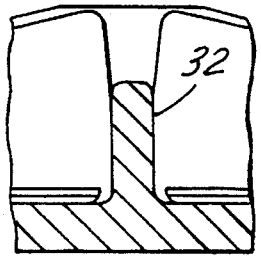
FIG. 5 is a sectional view taken along line 5—5 of FIG. 2.

When the solenoid coil assembly is not energized, the spring 18 located in the spring pocket 17, biases the armature 20 away from the stator 16 to cause the valve 27 to be operated closed and thereby stop ejection of liquid fuel from the fuel injector. When the solenoid coil assembly is energized, it pulls the armature 20 towards the stator 16 to cause the valve needle 22 to open the valve 27 in the body assembly 26 and thereby ejecting liquid fuel from the fuel injector 10. In accordance with the present invention, fuel flows through the multi-dimensional fluid passages or impact-minimization means 30 in the armature 20, as illustrated in FIG. 2, which fluid passages change dimension and shape along their depths. As seen in FIG. 4, the flow of fluid can reach the valve needle side of the armature through the various fluid passages 30.

The flat faced style of armatures are typically a disk shaped piece that is attached to or integral with the end of a valve needle. If the armature is placed outside of or overhangs the needle guiding points in a cantilevered condition, the mass of the armature becomes critical, as excess weight will impact negatively on the dynamics of the valve device. Providing a fluid path through the armature presents problems due to the attachment of the needle and the need to avoid negatively impacting the magnetic performance of the solenoid due to the addition of holes within the magnetic path.

The present invention solves these existing problems by providing the multi-dimensional fluid passages 30 through the armature 20 to reduce the mass of the armature to minimize the effect of impact forces on the armature and thereby reducing bounce and by adding the ribs 32 to maintain the desired or needed magnetic circuit path to maintain magnetic performance. This invention is particularly well suited for armatures where flow rate is high, because it eliminates the need for large drilled passages which negatively impact magnetic performance due to insufficient magnetic path area. The fluid flow through the solenoid valve requires the fluid to pass from the stator 16 through the fluid passages 30 in the armature 20 to the valve 27.

By careful analysis of the magnetic flux path through the armature, the amount, size and placement of the ribs 32 along with the size of the opening of the fluid passages 30 can be determined so as not to cause a negative impact on the magnetic performance of the solenoid valve. Weight savings is accomplished by removing material outside of the magnetic flux path on the valve needle side of the armature 20 through the size and shape of the passages 30. The volume of material removed results in a very compact armature design that is capable of providing the necessary fluid flow through the armature without weight increases and the amount and placement of the ribs 32 on the valve side of the armature minimizes the impact on the magnetic performance. The ribs typically extend from the axis of the armature where the ribs have their greatest volume to the outer peripheral edge of the armature to provide support and rigidity to the armature.

While the armature in this illustration is described as being for top feed fluid-flow conditions, the minimized mass also makes the armature desirable for bottom-feed solenoid valve products. The fluid passages connection from stator to valve needle side of the armature allow for the release of fluid trapped in the stator and the spring pocket 19 during the valve opening event. This venting action has the advantage of improving the dynamic performance of the solenoid valve by preventing the hydraulic locking effect.

The multi-dimensional fluid passages of the present invention may not be able to be economically machined using traditional turning and milling methods. Consequently, alternative methods for fabricating the armature and/or fluid passages, such as are known in the art, may be applied. An armature blank maybe formed with the ribs and then, the multi-dimensional fluid passages can be formed in the screw machined armature blank using an electrical discharge machining process, as known in the art. That is, an electrode machined to form the reverse image of the fluid passages is used to burn the shape into the machined armature.

Alternatively, the entire armature may be formed simultaneously. The armature may be made using the metal injection molding process or through the powdered metal process, both of which are known in the art and would form the fluid passages and the ribs in the armature as the armature is being formed.

Having described the invention in detail and by reference to the preferred embodiments thereof, it will be apparent that principles of the invention are susceptible to being implemented in other forms of solenoid-operated valves without departing from the scope of the invention defined in the appended claims.

What is claimed is:

1. A solenoid-operated fuel injector having a housing containing a solenoid having an outer pole member that is selectively energized by electric current to open and close the fuel injector, a stator magnetically coupled to the solenoid and forming an inner pole member and an outer pole member, an inlet connector tube that extends toward the stator to convey liquid fuel into the housing, a valve through which fuel is ejected from the housing, an armature that is normally biased relative to the stator, said armature is operable by the solenoid, a valve needle that is disposed within the housing and integral with and extending from one side of the armature and operable to open and close a flow path through the housing between the inlet connector tube and the valve, a magnetic circuit comprising the inner pole of the solenoid, the solenoid, the stator and the armature, the stator and the armature forming working gap therebetween characterized in that:

impact-minimization means on the armature to minimize the effect of impact forces when the armature is moved from its normal position to its operated position, and said impact-minimization means comprises multi-dimensional fluid passages extending from the one side of the armature to the opposite side of the armature; said impact-minimization means effectively reducing the mass of the armature and ribs on said one side of the armature to provide the desired mass for the magnetic circuit through the armature between the inner pole and outer pole on the stator, said ribs extending from the axis of the armature where said ribs have their greatest magnetic mass to the outer periphery of the armature where said ribs have their least mass.

2. A fuel injector as set forth in claim 1 characterized further in that said multi-dimensional fluid passages require the fluid to pass through the armature from the inlet connector to the valve.

3. A fuel injector as set forth in claim 1 characterized further in that said multi-dimensional fluid passages are situated near the periphery of the armature so as to avoid a negative impact on magnetic performance of the solenoid valve and to reduce the mass of the armature.

4. A method for minimizing loss of magnetic performance in a solenoid-operated fuel injector, the injector comprising a housing containing a solenoid coil with an outer pole said solenoid coil being selectively energized by electric current to operate the fuel injector, a stator comprising an inner pole and an outer pole, an inlet connector tube that extends toward the stator to convey liquid fuel into the housing and through the stator, a valve for ejecting fuel from the housing, an armature, a valve needle operatively connected to the armature and in response to the operation of the solenoid coil to open and close a flow path through the valve, the stator forming a portion of a magnetic circuit path that directs magnetic flux across a working gap that is disposed within the housing between an end of the stator and one side of the armature, characterized by the steps of:

providing impact-minimization means to minimize the effect of impact forces as a result of the operation of the injector, said impact-minimization means comprises on the armature multidimensional fluid passages through the armature that minimizes the mass of the armature and then providing ribs on the opposite side of the armature to localize the magnetic circuit near the axis of the armature, the ribs extending to the periphery of the armature to maintain armature rigidity.

5. A method for minimizing loss of magnetic performance in a solenoid-operated fuel injector as set forth in claim 4 characterized further in that said multi-dimensional fluid passages are situated so as to avoid a negative impact on magnetic performance of the solenoid valve.

6. A fuel injector having a housing having an inlet and a valve operated outlet, said housing containing a solenoid coil assembly with an outer pole, a stator providing an inner pole and an outer pole, and an armature biased relative to the stator and having means for operating the valve operated outlet, the armature characterized in that multi-dimensional fluid passages extend through the armature for directing fuel from the stator to the valve operated outlet, said fluid passages extending from near the axis of the armature to the periphery thereby reducing the mass of the armature; and ribs radially extending from the axis of the armature to the periphery for maintaining rigidity of the armature, said ribs having a larger mass at the axis with the mass tapering down toward the periphery.

* * * * *